US006568982B2

(12) United States Patent
Esterle

(10) Patent No.: US 6,568,982 B2
(45) Date of Patent: May 27, 2003

(54) BALL COMPRISED OF INTERWOVEN RINGS

(76) Inventor: Richard B. Esterle, 5712 Wilkins Ave, Pittsburgh, PA (US) 15217

( * ) Notice: Subject to any disclaimer, the term of this patent is extended or adjusted under 35 U.S.C. 154(b) by 0 days.

(21) Appl. No.: 09/821,914

(22) Filed: Mar. 30, 2001

(65) Prior Publication Data

US 2001/0041493 A1 Nov. 15, 2001

Related U.S. Application Data

(60) Provisional application No. 60/193,486, filed on Mar. 31, 2000.

(51) Int. Cl.[7] ..... A63H 33/12
(52) U.S. Cl. ..... 446/122; 446/124
(58) Field of Search ..... 446/85, 122, 124, 446/486, 487, 490, 437; 273/58 D, 58 R, 156, 158, 159, 58 B, 58 BA, 220; 482/55, 74, 105; 473/595, 167, 594

(56) References Cited

U.S. PATENT DOCUMENTS

| | | | | | |
|---|---|---|---|---|---|
| 563,170 | A | * | 6/1896 | Tuttle | 473/167 |
| 2,078,382 | A | * | 4/1937 | Hanshaw | 473/167 |
| 2,362,064 | A | * | 11/1944 | Giesinger | 473/167 |
| 2,771,768 | A | * | 11/1956 | Tudor | 70/457 |
| 3,626,634 | A | * | 12/1971 | Jones et al. | 446/122 |
| 4,595,369 | A | * | 6/1986 | Downs | 273/109 |
| 4,813,674 | A | * | 3/1989 | Lorhpipat | 446/107 |
| 5,224,959 | A | * | 7/1993 | Kasper | 446/26 |
| 5,566,937 | A | * | 10/1996 | Lorhpipat | 446/120 |
| 5,660,576 | A | * | 8/1997 | Winga | 446/490 |
| 6,287,226 | B1 | * | 9/2001 | Dilling | 446/437 |

* cited by examiner

*Primary Examiner*—Jacob K. Ackun
*Assistant Examiner*—Faye Francis
(74) *Attorney, Agent, or Firm*—Mirick, O'Connell, DeMallie & Lougee, LLP

(57) ABSTRACT

A ball comprising a plurality of interwoven rings, preferably each of generally polygonal shape.

8 Claims, 4 Drawing Sheets

BALL COMPRISED OF INTERWOVEN RINGS

CROSS REFERENCE TO RELATED APPLICATION

This application claims benefit of Provisional application No. 60/193,486, filed on Mar. 31, 2000.

FIELD OF THE INVENTION

This invention relates to a toy ball.

BACKGROUND OF THE INVENTION

Balls are typically spherical. Some balls are made to bounce while others are not. The spherical shape provides a regularity that is useful for certain types of play. However, the shape and the fact that these balls define a closed interior limits the types of play possible with the ball, as well as the appearance of the ball.

SUMMARY OF THE INVENTION

It is therefore the object of this invention to provide a ball comprising of plurality of interwoven loops to achieve a ball with a hollow interior, an interesting, complex surface shape, texture and appearance, and myriad possibilities for the functionality of the ball created by the shape of the loops and the materials from which the loops are made.

This invention features a ball comprising a plurality of interwoven loops, to achieve a ball with a hollow interior. The loops may have a generally polygonal shape. The loops may be generally pentagonal. The ball may comprise six generally pentagonal loops that are interwoven so that they lie generally along the planes of an icosidodecahedron solid. The loops may have protruding portions at one or more of the vertices. In one embodiment, the loops each have a protruding portion at each vertex. The protruding portions may be generally partially spherical. At least some of the loops preferably define butting ends that lie proximate one another within a connector means that may comprise a two-piece shell that fits over the butt ends, and is fixed thereto with adhesive.

The loops can be of any shape. In the embodiment with polygonal loops, the loops may have three, four, five or six sides, or more.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The invention comprises a ball made of a number of interwoven loops. The loops may be held together frictionally, or by mechanical means. In one embodiment, the loops are made of a relatively stiff but flexible material so that the ball is bouncy.

Figure 1:
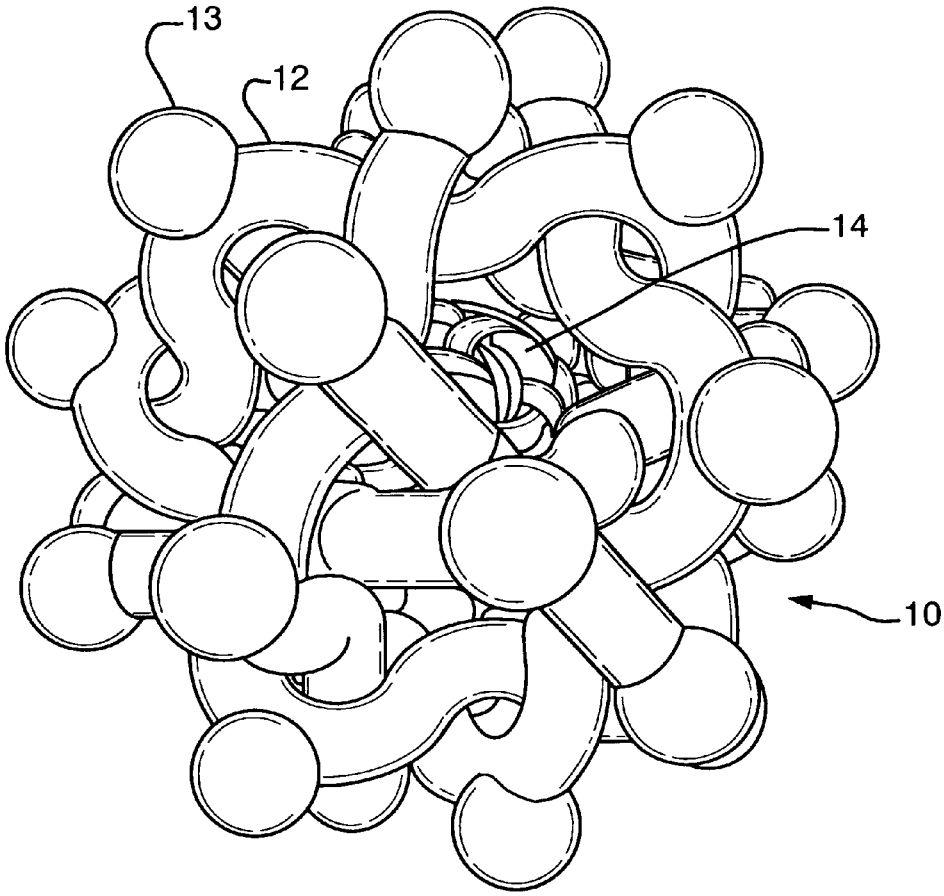
FIG. 1 is a view of the preferred embodiment of the ball of this invention comprising six interwoven generally pentagonal loops.
Figure 2:
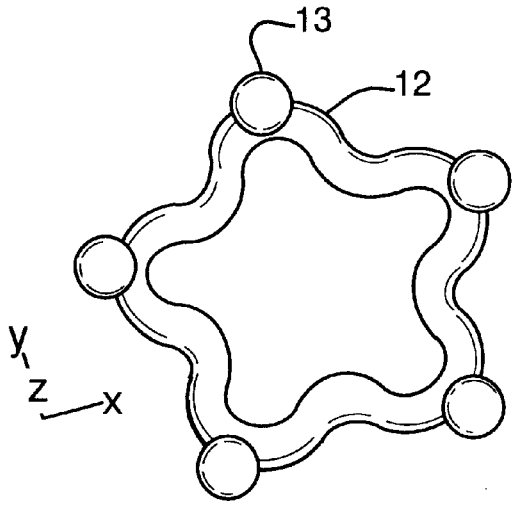
FIG. 2 is a front view of one of the loops of FIG. 1.
Figure 3:
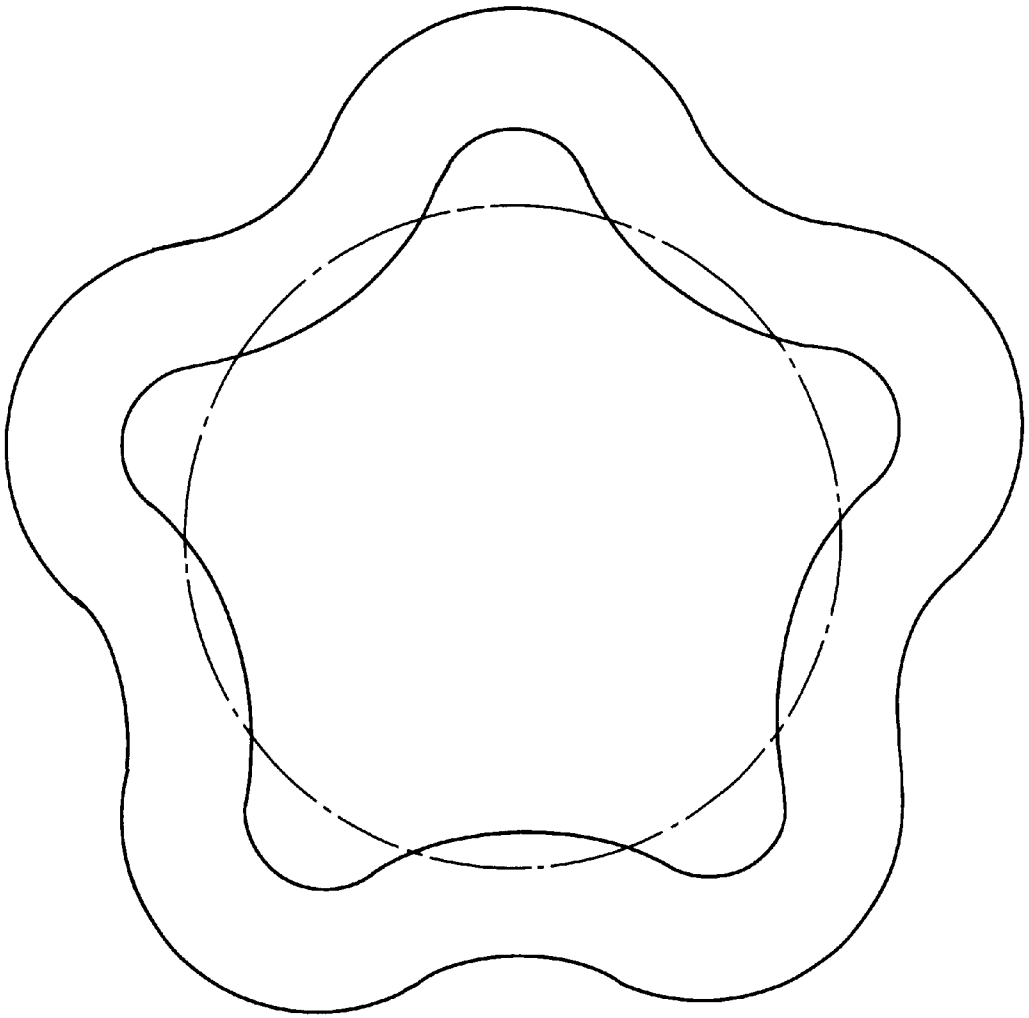
FIG. 3 is a front view of a similar loop but without the protruding portions at the vertices.

In the preferred embodiment shown in FIG. 1, the ball 10 comprises six identical loops each of which is generally pentagonal, as shown in FIG. 2. In this case, the six pentagonal-shape loop arrangement is configured to somewhat fill the shape of a sphere. The loops are coplanar with the planes of an icosidodecahedron solid and "weave" through and around each other to interlock in a generally spherical arrangement. The protruding partially spherical "knobs" 13 at each apex of the loops is an optional feature; one loop 12*a* without such knobs is show in FIG. 3. FIG. 3 also shows loop 12*a* in which the convex vertices and concave connecting sections have equal radii.

Figure 4A:
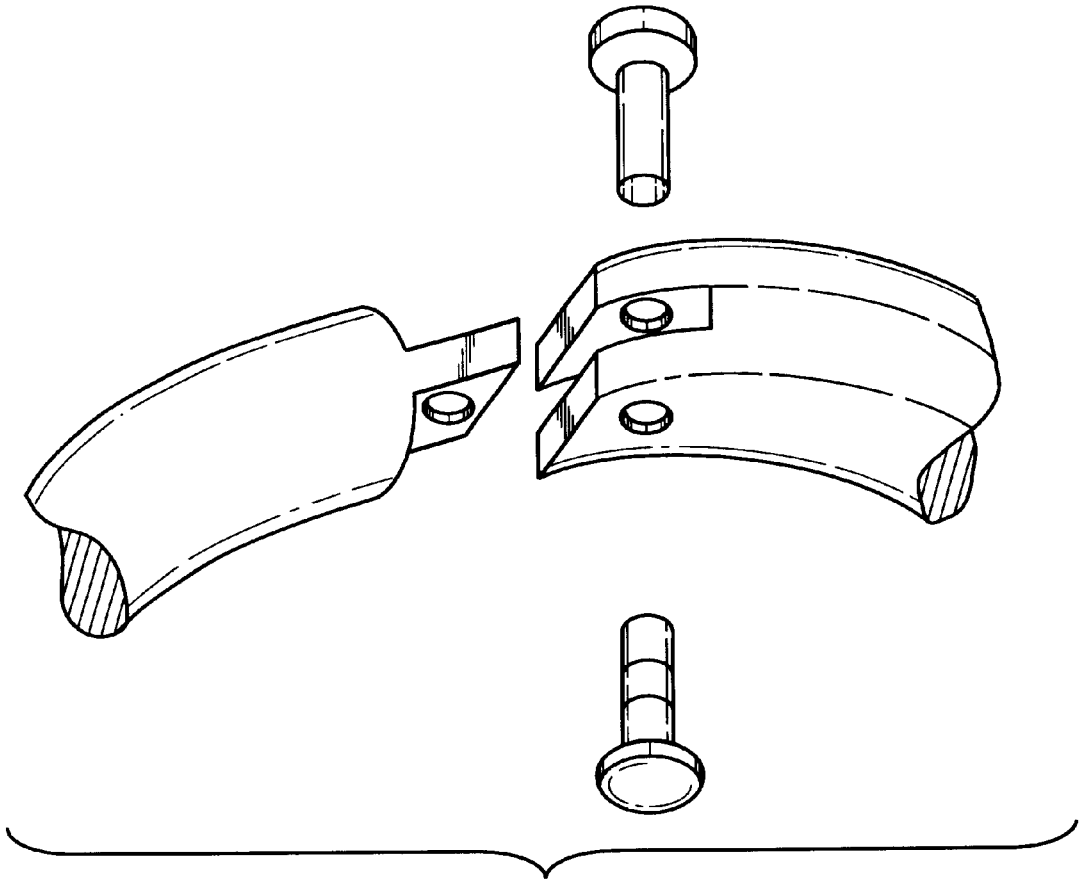
FIGS. 4A and 4B are an enlarged partially dissembled view of the one manner in which the loops of FIG. 1 and FIG. 2 are closed during assembly of the ball of the invention.
Figure 4B:
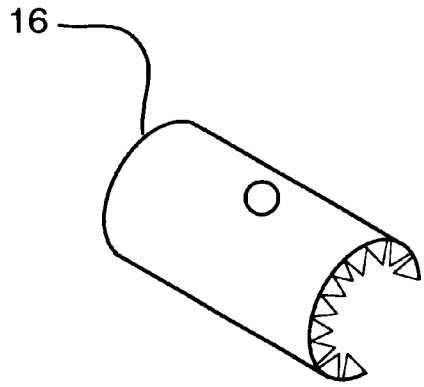
Figure 5A:
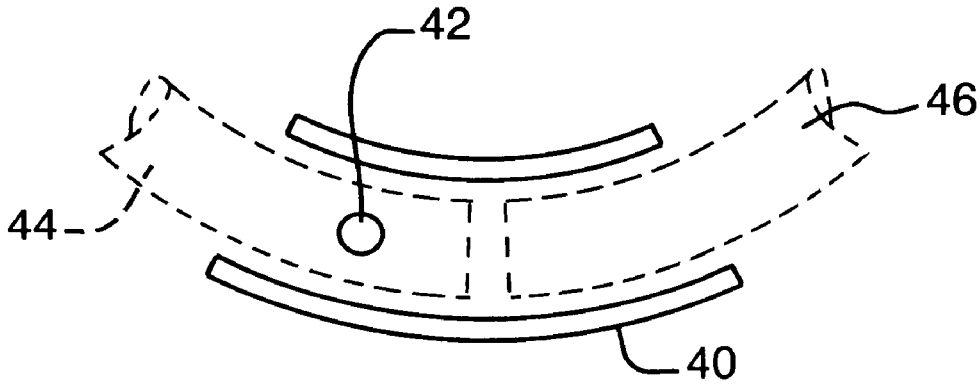
FIGS. 5A and 5B are partial views of the preferred manner in which the loops of FIG. 1 and FIG. 2 are closed during assembly of the ball of the invention.
Figure 5B:
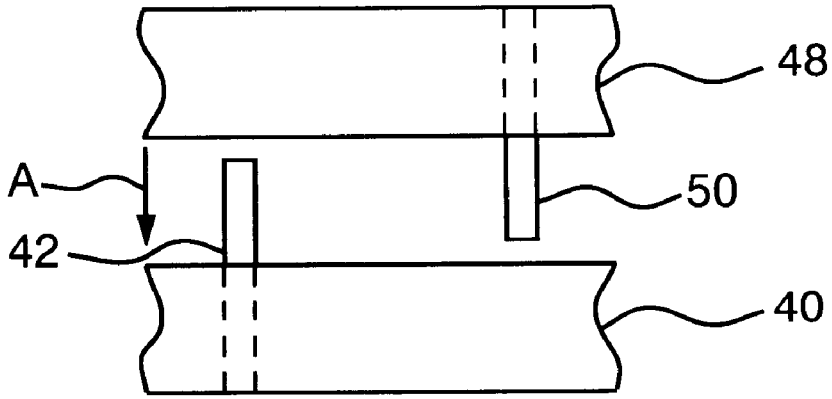

In order to manufacture the ball (since the loops are interwoven), each loop (or at least all but one) must be separable. One loop connector means is shown in FIGS. 4 and 4A, and comprises a separable mechanical fastener (the fork and pin arrangement shown), and also preferably an overlying split tube comprising two snap together half tubes 16, one of which is shown in the drawing, that may also include inwardly-directed teeth that grip the loop material, to hold the tube in place over the connector. This prevents consumer access to the connector. A preferred connector means is shown in FIGS. 5 and 5A. Hard plastic mating connector pieces 40 and 48 are each half-tubular shells that fit snugly over butting ends 44 and 46 of a loop. The shells may or may not include projecting pins 42 and 50 that pass through the loop to more 20 firmly hold it in place. Preferably, the loop butt ends are covered with an adhesive, and then shell pieces 44 and 46 are pushed together over the butting ends. The adhesive (together with the pins if used) holds the ends within the connector.

The ball may comprise fewer than six, or more than six, loops, and the loops, although preferably generally polygonal, need not be polygonal, and certainly need not be pentagonal. If polygonal, the loops can have three, four, five, six or more sides. The loops may be made of flexible polymer such as STYBUFLEX™, a styrenic thermoplastic elastomer available from Polychems Company, having a shore A hardness of between 45 and 95. The result is a slightly compressible ball that has some bounce, and the loops have enough flexibility to allow them to be interwoven as shown in FIG. 1. The protruding knobs give it more bounce. The projecting vertices cause a somewhat random bounce, which adds to the fin of using the ball.

The loop thickness is selected to achieve an appropriate strength, while having sufficient flexibility to allow the loops to be interwoven. For loops having diameters of about 5.5 and 2.75 inches, the loops may have a thickness of about 12 mm.

As shown in FIG. 1, the woven ball 10 may contain in its center another ball 14, which is preferably loosely received, so that it moves as the ball is moved. This central ball 14 may be mirrored to add to the ball's visual stimulation and interest.

The loops can alternatively be made inflatable. In another alternative embodiment, the loops could be made of a clear, hard plastic shell, so that they were hollow. In that case, the loops could contain balls or other small objects that rolled or tumbled along inside of the loops when the ball was moved.

What is claimed is:

1. A ball comprising:

a plurality of interwoven loops, each loop having a generally polygonal shape and defining a plurality of regularly spaced convex vertices separated by an equal plurality of regularly spaced concave connecting sections, the loops interwoven such that each of the loop apexes overlies a connecting section of another loop, to achieve a ball with a number of protruding apexes and a hollow interior.

2. The ball of claim 1, wherein the radii of the convex vertices and of the concave connecting portions are equal, so that the apexes and the connecting portions nest together.

3. The ball of claim 1, wherein the loops are generally pentagonal.

4. The ball of claim 1, wherein the loops have protruding portions at one or more of the vertices.

5. The ball of claim 4 wherein the loops each have a protruding portion at each vertex.

6. The ball of claim 4 wherein the protruding portions are generally partially spherical.

7. The ball of claim 1, wherein the loops have three sides.

8. The ball of claim 1, wherein the loops have four sides.

* * * * *